US010631569B2

(12) United States Patent
Papakyrillou

(10) Patent No.: US 10,631,569 B2
(45) Date of Patent: Apr. 28, 2020

(54) HYDROPHOBIC FILTER

(71) Applicant: PHILIP MORRIS PRODUCTS S.A., Neuchatel (CH)

(72) Inventor: Stefanos Papakyrillou, Cortaillod (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/536,262

(22) PCT Filed: Dec. 15, 2015

(86) PCT No.: PCT/IB2015/059638

§ 371 (c)(1),
(2) Date: Jun. 15, 2017

(87) PCT Pub. No.: WO2016/108119

PCT Pub. Date: Jul. 7, 2016

(65) Prior Publication Data

US 2017/0360087 A1 Dec. 21, 2017

Related U.S. Application Data

(60) Provisional application No. 62/097,215, filed on Dec. 29, 2014.

(51) Int. Cl.

| | |
|---|---|
| ***A24D 3/06*** | (2006.01) |
| ***A24D 3/10*** | (2006.01) |
| ***A24D 3/14*** | (2006.01) |

(52) U.S. Cl.

CPC ..... *A24D 3/067* (2013.01); *A24D 3/062* (2013.01); *A24D 3/10* (2013.01); *A24D 3/14* (2013.01)

(58) Field of Classification Search

CPC ..... A24D 3/06

See application file for complete search history.

(56) References Cited

U.S. PATENT DOCUMENTS

| | | | | |
|---|---|---|---|---|
| 2,999,503 A * | 9/1961 | Schur | A24D 3/10 131/340 |
| 4,015,611 A | 4/1977 | Holst et al. | |
| 4,107,426 A * | 8/1978 | Gordon | A61F 13/00991 229/5.85 |
| 4,341,228 A | 7/1982 | Keritsis et al. | |
| 5,584,306 A | 12/1996 | Beauman et al. | |
| 5,724,998 A | 3/1998 | Gellatly et al. | |

(Continued)

FOREIGN PATENT DOCUMENTS

| | | |
|---|---|---|
| CH | 691 156 A5 | 5/2001 |
| CN | 1129089 A | 8/1996 |

(Continued)

OTHER PUBLICATIONS

FR 2436571 Translation (Year: 1980).*

(Continued)

*Primary Examiner* — Eric Yaary

(74) *Attorney, Agent, or Firm* — Mueting, Raasch & Gebhardt, P.A.

(57) ABSTRACT

A smoking article includes a smokable material and a filter comprising filtration material that is downstream of the smokable material. The filtration material comprises a sheet of hydrophobic cellulosic material with hydrophobic groups covalently bonded to the cellulosic material.

18 Claims, 2 Drawing Sheets

(56) References Cited

U.S. PATENT DOCUMENTS

| | | | | |
|---|---|---|---|---|
| 5,856,006 | A | 1/1999 | Asai et al. | |
| 6,145,511 | A | 11/2000 | Teufel et al. | |
| 6,216,706 | B1 | 4/2001 | Kumar et al. | |
| 6,342,268 | B1 | 1/2002 | Samain | |
| 2012/0305015 | A1* | 12/2012 | Sebastian | A24D 3/068 131/332 |
| 2013/0236647 | A1 | 9/2013 | Samain et al. | |
| 2015/0001148 | A1* | 1/2015 | Pan | D21H 27/08 210/508 |
| 2015/0329707 | A1 | 11/2015 | Roggenstein et al. | |

FOREIGN PATENT DOCUMENTS

| | | | | |
|---|---|---|---|---|
| CN | 104130355 | A | 11/2014 | |
| EP | 0 706 766 | A2 | 4/1996 | |
| FR | 2436571 | A1 * | 4/1980 | A24D 3/06 |
| GB | 1 561 659 | A | 2/1980 | |
| JP | 1969-001944 | B | 1/1944 | |
| JP | 2001515103 | A | 9/2001 | |
| RU | 2113809 | C1 | 6/1998 | |
| RU | 2140758 | C1 | 11/1999 | |
| WO | WO 2004/074449 | A2 | 9/2004 | |
| WO | WO 2012/166302 | A2 | 5/2012 | |
| WO | WO 2013/019413 | A2 | 2/2013 | |
| WO | WO 2014/090665 | A1 | 6/2014 | |
| WO | WO 2014/201344 | A1 | 12/2014 | |

OTHER PUBLICATIONS

International Preliminary Report on Patentability for PCT/IB2015/059638, issued by the International Bureau of WIPO, dated Jul. 13, 2017, 7 pgs.

International Search Report and Written Opinion issued by the European Patent Office, for PCT/IB2015/059638, dated Apr. 29, 2016; 13 pgs.

Cunha et al., "Turning polysaccharides into hydrophobic materials: a critical review. Part 1. Cellulose," *Cellulose*, Jul. 11, 2010;17(5):875-889.

Papermaking Chemicals, Zhang Guanghua, pp. 250-254, China Petrochemical Press, 1st Edition, Including English Translation; 17 pgs.

Chinese Office Action for CN 201580068671.4, issued by the Chinese Patent Office dated May 17, 2019; including English Translation: 19 pgs.

Varshoei, et al., "The Performance of Alkylketene Dimer (AKD) for the Internal Sizing of Recycled OCC Pulp," *Lignocellulose*, 2013:2(1):316-326.

Russian Office Action for RU Application No. 2017127183 dated Jul. 23, 2019, including English Translation; 12 pgs.

Japanese Office Action dated Jan. 6, 2020, for JP Application No. 2017-533442; 5 pgs.

Chinese Office Action dated Jan. 10, 2020, for CN application No. 201580068671.4; 20 pgs. Including English Translation.

* cited by examiner

HYDROPHOBIC FILTER

This application is the § 371 U.S. National Stage of International Application No. PCT/162015/059638, filed 15 Dec. 2015, which claims the benefit of U.S. Provisional Application No. 62/097,215, filed 29 Dec. 2014, the disclosures of which are incorporated by reference herein in their entireties.

The present invention relates to filters used in smoking articles, wherein the filter comprises filtration material that is hydrophobic.

Combustible smoking articles, such as cigarettes, typically comprise a cylindrical rod of tobacco cut filler surrounded by a wrapper and a cylindrical filter axially aligned in an abutting end-to-end relationship with the wrapped tobacco rod. The cylindrical filter typically comprises a filtration material circumscribed by a plug wrap. The wrapped tobacco rod and the filter are joined by a band of tipping wrapper, normally formed of a paper material that circumscribes the entire length of the filter and an adjacent portion of the wrapped tobacco rod. A cigarette is employed by a consumer by lighting one end thereof and burning the shredded tobacco rod. The smoker then receives mainstream smoke into their mouth by drawing on the mouth end or filter end of the cigarette.

Some smoking articles comprise an aerosol generating substrate containing tobacco which is heated rather than combusted when it is consumed. Known heated smoking articles include, for example, smoking articles in which an aerosol is generated by electrical heating or by the transfer of heat from a combustible fuel element or a heat source to an aerosol generating substrate. During smoking, volatile compounds are released from the aerosol generating substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco-containing material or other nicotine source, without combustion or heating, for example through a chemical reaction.

Many smoking articles comprise a filter aligned in end-to-end relationship with a tobacco rod. Some smoking articles include a filter element with functional materials that capture or convert components of the mainstream smoke or aerosol as the mainstream smoke or aerosol is being drawn through the filter. Such functional materials are known and include, for example, sorbents, catalysts and flavourants.

Paper has been utilized to form filter elements. Advantageously, paper filter elements may degrade quicker than the cellulose acetate tow traditionally utilized in conventional cigarette filters. However paper filter elements are not well received by the consumer. A paper filter generally has a high water absorption and retention property that can result in a dry harsh taste in the mainstream smoke.

It would be desirable to provide smoking articles that include filter elements formed of sheets of paper that can maintain the sensory perception of conventional cellulose acetate tow filter elements. It would be desirable to provide a smoking article that included filter elements formed of sheets of paper that did not readily absorb water or moisture found in the mainstream smoke or aerosol passing through the smoking article. It would also be desirable that the paper filter element not affect the taste of the smoke or aerosol generated by the smoking article.

According to a first aspect, a smoking article includes a smokable material and a filter comprising filtration material that is downstream of the smokable material. The filtration material comprises a hydrophobic cellulosic material with hydrophobic groups covalently bonded to the cellulosic material. The hydrophobic cellulosic material has a water contact angle of at least about 90 degrees or at least about 100 degrees and a Cobb measurement value (at 60 seconds) of about 40 g/m2 or less, or about 35 g/m2 or less.

In another aspect, a filter for a smoking article comprises layers of a crimped hydrophobic cellulosic material that are packed to form a cylindrical filter element.

In a further aspect, the filter for a smoking article is formed by a process comprising the steps of: applying a liquid composition comprising a fatty acid halide to a surface of the sheet of cellulosic material, and maintaining the surface at a temperature of about 120° C. to about 180° C. The fatty acid halide reacts in-situ with protogenic groups on the sheet of cellulosic material resulting in the formation of fatty acid esters and a hydrophobic sheet of cellulosic material. Then the hydrophobic sheet of cellulosic material is crimped and formed into a filter element and incorporated into a smoking article.

Smoking articles that include a sheet of hydrophobic cellulosic material can reduce wetting or absorption of water or moisture from mainstream smoke or aerosol that is passing through the filter. As a result, the filtration material does not negatively affect the taste of the mainstream smoke or aerosol as perceived by a consumer consuming the smoking article. Smoking article filters formed of these sheets of hydrophobic cellulosic material can degrade more rapidly than the cellulose acetate tow that is currently utilized in cigarette filters.

Smoking articles in accordance with the present disclosure may be filter cigarettes or other smoking articles in which tobacco material forming a tobacco substrate or tobacco rod is combusted to form mainstream smoke. A tipping wrapper joins a filter to the tobacco substrate or rod. The term "smoking article" is used here indicates cigarettes, cigars, cigarillos and other articles in which a smokeable material, such as a tobacco, is lit and combusted to produce smoke.

The term "smoking article" also includes an aerosol-generating article in which an aerosol comprising nicotine is generated by heat without combusting the aerosol-forming substrate (smokable material), such as tobacco substrate. In one type of heated smoking article, an aerosol generating substrate is heated by one or more electrical heating elements to produce an aerosol. In another type of heated smoking article, an aerosol is produced by the transfer of heat from a combustible or chemical heat source to a physically separate aerosol generating substrate, which may be located within, around or downstream of the heat source. The present disclosure further encompasses smoking articles in which a nicotine-containing aerosol is generated from a tobacco material, tobacco extract, or other nicotine source, without combustion, and in some cases without heating, for example through a chemical reaction.

The term "tobacco substrate" or "aerosol-generating substrate" includes a rod of tobacco formed of shredded tobacco or tobacco cut filler, or it may include reconstituted tobacco or cast leaf tobacco, or a mixture of both. The tobacco substrate can be connected to the mouthpiece or filter in an end-to-end relationship, as further discussed below.

The term "mouthpiece" is used herein to indicate the portion of the smoking article that is designed to be contacted with the mouth of the consumer. The mouthpiece can be the portion of the smoking article that can includes a filter, or in some cases the mouthpiece can be defined by the extent of the tipping wrapper. In other cases, the mouthpiece can be defined as a portion of the smoking article extending about 40 mm from the mouth end of the smoking article, or extending about 30 mm from the mouth end of the smoking article.

The term "aerosol-generating article" is used herein to refer to heated smoking articles or smoking articles that are not cigarettes, cigars, cigarillos, or that combust a tobacco substrate to produce smoke. Smoking articles according to the invention may be whole, assembled smoking devices or components of smoking devices that are combined with one or more other components in order to provide an assembled device for producing an aerosol, such as for example, the consumable part of a heated smoking device or aerosol-generating article.

The terms "upstream" and "downstream" refer to relative positions of elements of the smoking article described in relation to the direction of mainstream smoke or aerosol as it is drawn from a tobacco substrate or aerosol-generating substrate and through the filter or mouthpiece.

The term "mainstream smoke" is used herein to indicate smoke produced by combustible smoking articles, such as cigarettes, and aerosols produced by non-combustible smoking articles as described above. Mainstream smoke flows through the smoking article and is consumed by the user.

The term "plug wrap" is used herein to define a wrap which circumscribes only the mouthpiece or a portion of the mouthpiece. Where the mouthpiece is formed of a single segment, such as a single segment of filtration material, the plug wrap will circumscribe the single segment and will generally be the only material between the underlying segment or filtration material and the tipping wrapper. Where the mouthpiece is formed of a set of multiple segments, the term "plug wrap" can refer to segment plug wraps which each circumscribe only a single segment or a sub-set of the segments, or the term can refer to a combining plug wrap which circumscribes all of the segments and any segment plug wraps.

The term "hydrophobic" refers to a surface exhibiting water repelling properties. One useful way to determine this is to measure the water contact angle. The "water contact angle" is the angle, conventionally measured through the liquid, where a liquid/vapour interface meets a solid surface. It quantifies the wettability of a solid surface by a liquid via the Young equation.

The present disclosure provides a filter element comprising filtration material that comprises cellulose, such as paper, wood, textile, natural as well as artificial fibres, wherein this cellulose material exhibits hydrophobic properties. The hydrophobic filtration material forms at least a portion of the filter for a smoking article. The hydrophobic filter material can be formed of a sheet of hydrophobic cellulosic material which fills at least a portion of the interior of the filter element. Preferably the hydrophobic filter material is formed of a continuous sheet of hydrophobic cellulosic material which fills at least a portion of the interior of the filter element. Preferably the filter element has a cylindrical shape and a circular cross-section. According to the invention, hydrophobic groups are covalently bonded to the protegenic groups, such as hydroxyl groups, on the cellulosic material forming the sheet of cellulosic material to provide the hydrophobic property.

It is contemplated that the hydrophobic filtration material can reduce and prevent water and moisture retention or adsorption from mainstream smoke of the smoking article. As a result, the hydrophobic filtration material does not negatively affect the taste of the mainstream smoke or aerosol.

The hydrophobic filter material can also inhibit the transfer, absorption and accumulation of humectant, water and staining of the filter element that occurs when the smoking article is stored or utilized in a humid environment, particularly where the humidity is very high (e.g., relative humidity greater than 70%, 80%, 90%, 95%, 99%) or when the smoking article is stored for an extended period, (e.g., more than three weeks, two months, three months, or six months), or a combination of such conditions.

In various embodiments, the hydrophobic cellulosic material forming the filter element is provided as flat or planar continuous sheets with at least one hydrophobic surface. A hydrophobic sheet of cellulosic material has a Cobb water absorption (ISO535:1991) value (at 60 seconds) of less than about 40 $g/m^2$, less than about 35 $g/m^2$, less than about 30 $g/m^2$, or less than about 25 $g/m^2$.

In various embodiments, the sheet of cellulosic material has a water contact angle of at least about 90 degrees, at least about 95 degrees, at least about 100 degrees, at least about 110 degrees, at least about 120 degrees, at least about 130 degrees at least about 140 degrees, at least about 150 degrees, at least about 160 degrees, or at least about 170 degrees. Hydrophobicity is determined by utilizing the TAPPI T558 om-97 test and the result is presented as an interfacial contact angle and reported in "degrees" and can range from near zero degrees to near 180 degrees. Where no contact angle is specified along with the term hydrophobic, the water contact angle is at least 90 degrees.

The hydrophobic surface can be uniformly present along the length of the sheet of cellulosic material or filter element. In some configurations the hydrophobic surface is not uniformly present along the length of the sheet of cellulosic material or filter element. For example, the hydrophobic surface may be preferentially present on portions of the sheet of cellulosic material or filter element and not present on other portions of the sheet of cellulosic material or filter element.

The hydrophobic filter element is formed of at least one sheet of hydrophobic cellulosic material, such as paper, which is crimped. Apparatus for supplying a sheet of cellulosic material is known and can be arranged so that the sheet material is fed directly into a rod-forming device for making filters and is also known in the art. The apparatus typically comprises a winding unit for unwinding the sheet material from a support on which the sheet material is supplied, such as a bobbin, and a crimping unit for crimping the sheet material. The sheet material is crimped preferably in the longitudinal direction or machine direction, i.e., in substantially the same direction as the direction of transport of the sheet material. The crimped sheet material is then gathered, preferably in the transverse direction, to form a filter rod. The crimped sheet material may be drawn through a funnel-like part with converging walls which compresses the crimped sheet material in the transverse direction, folds the sheet material onto itself randomly forming layers, and packs the layers of crimped continuous sheet material into a cylindrical space, to form a sub-dividable filter rod. The compression of the sheet material is then followed by cutting of the filter rod to form individual filter plugs. The width (a dimension in the transverse direction) of the sheet material has a direct relation to the packing density of the sheet material per unit length of the filter rod, and affects the resistance to draw of the filter rod. The term "transverse" is to be understood to be a direction other than the direction of transport of the sheet material but include a direction that is substantially perpendicular to it. The width of the sheet of hydrophobic cellulosic material, before crimping, in a transverse direction that is substantially perpendicular to the transport of the sheet material is about 50 mm to about 300 mm, about 100 mm to about 250 mm, about 170 mm to about 230 mm, or about 180 mm, about 190 mm, about 200 mm, about 210 mm, or about 220 mm. It is contemplated that the crimped, sheet of hydrophobic cellulosic material can be packed to form a filter element for making a filter having a cross-sectional circumference of about 15 mm to about 30 mm or a diameter of about 4.5 mm to about 9.5 mm, including a circumference of about 16.24 to 16.36 mm (corresponding to a diameter of about 5.17 mm to 5.20 mm), or about 23.24 mm to 23.53 mm (corresponding to a diameter of about 7.40 mm to 7.49 mm).

Typically the hydrophobic filter element has an elongated rod shape and a substantially circular cross-section. The crimped sheet of hydrophobic cellulosic material is made by a crimping unit that comprises a first pair of crimping rollers for engaging and crimping the sheet being transported between them. The crimping rollers have a surface which is arranged and configured to crimp the sheet material in the direction of transport of the sheet material. Preferably, the crimping rollers have a surface which is provided with means adapted to crimp the sheet material in the longitudinal direction of the sheet material. By way of example, the means adapted to crimp the sheet material in the direction of transport of the sheet material may comprise a structure on the surface of the rollers. In particular such a structure may comprise for example ridges and valleys running circumferentially about the axis of rotation of the rollers and can be parallel with the longitudinal direction. The sheet material is crimped by transferring the structure to the sheet material as it passes between the rollers. The grooved structure is transferred to the now crimped sheet material in the longitudinal direction which stretches and reduces the stability of the sheet material in a transverse direction. The sheet of hydrophobic cellulosic material thus comprises a series of parallel and co-extensive ridges and valleys along a longitudinal length of the sheet.

According to some embodiments, a valley to valley or ridge to ridge distance (also referred to as the "pitch") of the crimped structure on the sheet material (without any compression in the transverse direction) or the crimping structure on the surface of the rollers in the transverse direction may be in the range from about 0.5 mm to about 2 mm. Preferably, a pitch of the crimping structure is in a range from about 0.6 mm to about 1.5 mm, more preferably in a range of about 0.8 mm and about 1.2 mm, for example about 1.0 mm. The degree or magnitude of crimping is reflected by the depth of the valleys (or height of the ridges) on the crimped structure of the sheet material which refers to the distance between the ridge of one roller and the corresponding valley of the opposing roller, when the sheet material is passed between the rollers. Exemplary distances include about 0.25 mm, about 0.5 mm, about 0.75 mm, about 1.0 mm, about 1.25 mm, or about 1.5 mm. The depth is related to the stretching of the sheet material in the transverse direction and affects the change in dimensions in the transverse direction of the sheet material. The resistance to draw (RTD) of a filter element is related to the degree of stretching of the crimped sheet material. Any combination of depth and pitch within the above given ranges may be chosen according to the dimensions and specification of the final rod-shaped article to be manufactured. Preferably, a valley to valley distance is measured from center to center of the valleys or from the deepest point to deepest point of the valley.

The sheet of cellulosic material can be formed of any suitable cellulose material, preferably cellulose material derived from plants, such as paper and preferably crêpe paper. Crêpe paper having a grammage or basis weight of about 35 g/m$^2$ is preferred. A crêpe ratio of 10-30% is preferred which reflects the extent the paper has shortened during crêping. In many embodiments the sheet of cellulosic material is formed of a material with pendent protogenic groups. The term "protogenic" refers to a group that is able to donate a hydrogen or a proton in a chemical reaction. Preferably, the protogenic groups are reactive hydrophilic groups such as but not limited to a hydroxyl group (—OH), an amine group (—$NH_2$), or a sulfhydryl group (—$SH_2$). The invention will now be described, by way of example, with reference to sheet of cellulosic material comprising hydroxyl groups. Material with pendent hydroxyl groups includes cellulosic material such as paper, wood, textile, natural as well as artificial fibers. The sheet of cellulosic material can also include one or more filler materials, for example calcium carbonate or activated carbon.

A sheet of cellulosic material can have any suitable basis weight. The basis weight of a sheet of hydrophobic cellulosic material can be in a range from about 20 to about 60 grams per square meter or from about 30 to about 45 grams per square meter, or about 35 grams per square meter. A sheet of cellulosic material can have any suitable thickness. The thickness of a sheet of cellulosic material can be in a range from about 20 to about 100 micrometres or from about 20 to about 60 micrometres, or from about 30 to 50 micrometres.

The hydrophobic surface of the cellulose material can be formed with any suitable hydrophobic reagent or hydrophobic group. The hydrophobic reagent is preferably chemically bonded to the cellulosic material or pendent protogenic groups of the cellulosic material. In many embodiments the hydrophobic reagent is covalently bonded to the cellulosic material or pendent protogenic groups of the cellulosic material. For example, the hydrophobic group is covalently bonded to pendent hydroxyl groups of cellulosic material forming the sheet. A covalent bond between structural components of the cellulosic material and the hydrophobic reagent can form hydrophobic groups that are more securely attached to the paper material than simply disposing a coating of hydrophobic material on the cellulosic material forming the sheet. By chemically bonding the hydrophobic reagent at the molecular level in-situ rather than applying a layer of hydrophobic material in bulk to cover the surface allows the permeability of the paper to be better maintained, since a coating tends to cover or block pores in the cellulosic material forming the continuous sheet and reduce the permeability. Chemically bonding hydrophobic groups to the cellulosic material forming the sheet in-situ can also reduce the amount of material required to render the surface of the cellulosic material forming the sheet hydrophobic. The term "in-situ" as used herein refers to the location of the chemical reaction which takes place on or near the surface of the solid material that forms the sheet, which is distinguishable from a reaction with cellulose dissolved in a solution. For example, the reaction takes place on or near the surface of cellulosic material forming the sheet which comprises cellulosic material in a heterogeneous structure. However, the term "in-situ" does not require that the chemical reaction takes place directly on cellulosic material forming the sheet.

In one embodiment of the invention, the hydrophobic reagent comprises an acyl group or fatty acid group. The acyl group or fatty acid group or mixture thereof can be saturated or unsaturated. A fatty acid group (such as a fatty acid halide) in the reagent can react with pendent protogenic groups such as hydroxyl groups of the cellulosic material to form an ester bond covalently bonding the fatty acid to the cellulosic material. In essence, these reactions with the pendant hydroxyl groups can esterify the cellulosic material.

The acyl group or fatty acid group includes a $C_{12}$-$C_{30}$ alkyl (an alkyl group having from 12 to 30 carbon atoms), a $C_{14}$-$C_{24}$ alkyl (an alkyl group having from 14 to 24 carbon atoms) or preferably a $C_{16}$-$C_{20}$ alkyl (an alkyl group having from 16 to 20 carbon atoms). Those skill in the art would understand that the term "fatty acid" as used herein refers to long chain aliphatic, saturated or unsaturated fatty acid that comprises 12 to 30 carbon atoms, 14 to 24 carbon atoms, 16 to 20 carbon atoms or that has greater than 15, 16, 17, 18, 19, or 20 carbon atoms. In various embodiments, the hydrophobic reagent includes an acyl halide, a fatty acid halide, such as, a fatty acid chloride including palmitoyl chloride, stearoyl chloride or behenoyl chloride, a mixture thereof, for example. The in-situ reaction between fatty acid chloride and cellulosic material forming the sheet results in fatty acid esters of cellulose and hydrochloric acid.

Any suitable method can be utilized to chemically bond the hydrophobic reagent or group to the cellulosic material forming the continuous sheet. Preferably this method is a solvent-free method.

As one example, an amount of hydrophobic reagent, such as an acyl halide, a fatty acid halide, a fatty acid chloride, palmitoyl chloride, stearoyl chloride or behenoyl chloride, a mixture thereof, is deposited without solvent at the surface of the sheet at a controlled temperature, for example, droplets of the reagents forming 20-micrometer regularly-spaced circles on the surface. The control of the vapour tension of the reagent can promote the propagation of the reaction by diffusion with the formation of ester bonds between fatty acid and cellulose while continuously withdrawing unreacted acid chloride. The esterification of cellulose is in some cases based on the reaction of alcohol groups or pendent hydroxyl groups of cellulose with an acyl halide, such as an acyl chloride including a fatty acid chloride. The temperature that can be used to heat the hydrophobic reagent depends on the chemical nature of the reagent and for fatty acid halides, it ranges from about 120° C. to about 180° C.

The hydrophobic reagent can be applied to the cellulosic material of the sheet in any useful amount or basis weight. In many embodiments the basis weight of the hydrophobic reagent is less than about 3 grams per square meter, less than about 2 grams per square meter, or less than about 1 gram per square meter or in a range from about 0.1 to about 3 grams per square meter, from about 0.1 to about 2 grams per square meter, or from about 0.1 to about 1 gram per square meter. The hydrophobic reagent can be applied or printed on the cellulosic material of the sheet surface and define a uniform or non-uniform pattern.

Preferably the sheet of hydrophobic cellulosic material is formed by reacting a fatty acid ester group or a fatty acid group with pendent hydroxyl groups on the cellulosic material of the continuous sheet to form a hydrophobic surface. The reacting step can be accomplished by applying a fatty acid halide (such as chloride, for example) which provides the fatty acid ester group or a fatty acid group to chemically bond with pendent hydroxyl groups on the cellulosic material of the sheet to form a hydrophobic surface. The applying step can be carried out by loading the fatty acid halide in liquid form, without using a solvent, onto a solid support, such as a brush, a roller, or an absorbent or non-absorbent pad, and then contacting the solid support with a surface of the sheet. The fatty acid halide can also be applied by printing techniques, such as gravure, flexography, ink jet, heliography, by spraying, by wetting, or by immersion in a liquid comprising the fatty acid halide. The applying step can deposit discrete islands of reagent forming a uniform or non-uniform pattern of hydrophobic areas on the surface of the sheet. The uniform or non-uniform pattern of hydrophobic areas on the sheet can be formed of at least about 100 discrete hydrophobic islands, at least about 500 discrete hydrophobic islands, at least about 1000 discrete hydrophobic islands, or at least about 5000 discrete hydrophobic islands. The discrete hydrophobic islands can have any useful shape such as a circle, rectangle or polygon. The discrete hydrophobic islands can have any useful average lateral dimension. In many embodiments the discrete hydrophobic islands have an average lateral dimension in a range from 5 to 100 micrometres, or in a range from 5 to 50 micrometres. To aid diffusion of the applied reagent on the surface, a gas stream can also be applied. Apparatus and processes such as those described in US patent publication 20130236647, incorporated herein by reference in its entirety, can be used to produce the hydrophobic sheet.

According to the invention, the sheet of hydrophobic cellulosic material, that can be used in the hydrophobic filter element, can be produced by a process comprising applying a liquid composition comprising an aliphatic acid halide (preferably a fatty acid halide) to at least one surface of a sheet, optionally applying a gas stream to the surface to aid diffusion of the applied fatty acid halide, and maintaining the surface at a temperature about 120° C. to about 180° C., wherein the fatty acid halide reacts in-situ with the hydroxyl groups of the cellulosic material in the sheet resulting in the formation of fatty acid esters. Preferably, the sheet is made of paper, and the fatty acid halide is stearoyl chloride, palmitoyl chloride, or a mixture of fatty acid chlorides with 16 to 20 carbon atoms in the acyl group. Preferably, the fatty acid halide is not dissolved in a solvent in the liquid composition that is applied to the surface. The hydrophobic sheet produced by a process described hereinabove is thus distinguishable from material made by coating the surface with a layer of pre-made fatty acid ester of cellulose.

The hydrophobic sheet and resulting hydrophobic filter element is produced by a process of applying the liquid reagent composition to the at least one surface of a sheet at a rate of in a range from about 0.1 to about 3 grams per square meter, or from about 0.1 to about 2 grams per square meter, or from about 0.1 to about 1 gram per square meter. The liquid reagent applied at these rates renders the surface of the sheet and resulting filter element hydrophobic.

In many embodiments, the thickness of the sheet allows the hydrophobic groups or reagent applied to one surface to spread onto the opposing surface effectively providing similar hydrophobic properties to both opposing surfaces. In one example, the thickness of the sheet was about 43 micrometres and both surfaces were rendered hydrophobic by the gravure (printing) process using stearoyl chloride as the hydrophobic reagent to one surface.

In some embodiments, the material or method to create the hydrophobic nature of the hydrophobic filter element does not substantially affect the permeability of the filter element. Preferably, the reagent or method to create the hydrophobic filter element changes the permeability of the filter element (as compared to the untreated filter element) by less than about 10% or less than about 5% or less than 1%.

In many embodiments the hydrophobic surface can be formed by printing reagent along the length of the hydrophobic filter element or sheet of cellulosic material. Any useful printing methods can be utilized. The reagent can include any useful hydrophobic groups that can be reacted to chemically bond to the pendent groups of the cellulosic material.

In many embodiments the hydrophobic surface can be formed by printing reagent along the length of the cellulosic material. Any useful printing methods can be utilized such as gravure, ink jet and the like. The reagent can include any useful hydrophobic groups that can be covalently bonded to the cellulosic material or pendent groups of the cellulosic material.

Smoking articles, such as cigarettes and aerosol generating articles, include a tobacco substrate or an aerosol generating substrate that comprises a charge of tobacco circumscribed by a wrapper. The tobacco substrate may comprise any suitable type or types of tobacco material or tobacco substitute, in any suitable form. Preferably, the tobacco rod includes flue-cured tobacco, Burley tobacco, Maryland tobacco, Oriental tobacco, specialty tobacco, homogenized or reconstituted tobacco, or any combination thereof. Preferably, the tobacco is provided in the form of tobacco cut filler, tobacco lamina, processed tobacco materials, such as volume expanded or puffed tobacco, processed tobacco stems, such as cut-rolled or cut-puffed stems, homogenized tobacco, reconstituted tobacco, cast leaf tobacco, or blends thereof, and the like. The term "tobacco cut filler" is used herein to indicate tobacco material that is predominately formed from the lamina portion of the tobacco leaf. The terms "tobacco cut filler" is used herein to indicate both a single species of *Nicotiana* and two or more species of *Nicotiana* forming a tobacco cut filler blend.

As used herein, the term "homogenised tobacco" denotes a material formed by agglomerating particulate tobacco. Homogenized tobacco may include reconstituted tobacco or cast leaf tobacco, or a mixture of both. The term "reconstituted tobacco" refers to paper-like material that can be made from tobacco by-products, such as tobacco fines, tobacco dusts, tobacco stems, or a mixture of the foregoing. Reconstituted tobacco can be made by extracting the soluble chemicals in the tobacco by-products, processing the leftover tobacco fibers into a sheet, and then reapplying the extracted materials in concentrated form onto the sheet. The term "cast leaf tobacco" is used herein to refer to a product resulting from a process well known in the art, which is based on casting a slurry comprising ground tobacco particles and a binder (for example, guar) onto a supportive surface, such as a belt conveyor, drying the slurry and removing the dried sheet from the supportive surface. Exemplary methods for producing these types of tobacco substrate or aerosol-generating substrates are described in U.S. Pat. Nos. 5,724,998; 5,584,306; 4,341,228; 5,584,306 and 6,216,706. In various embodiments, the homogenised tobacco is formed into a sheet which is crimped, convoluted, folded, or otherwise compressed, before being wrapped to form a tobacco rod. For example, sheets of homogenised tobacco material for use in the invention may be crimped using a crimping unit of the type described in CH-A-691156, which comprises a pair of rotatable crimping rollers. However, it will be appreciated that sheets of homogenised tobacco material for use in the invention may be textured using other suitable machinery and processes that deform or perforate the sheets of homogenised tobacco material.

The tobacco substrate or aerosol-generating substrate used in heated smoking articles or aerosol-generating articles generally includes a higher level of humectant(s) than combusted smoking articles, such as cigarettes. Humectants can also be referred to as an "aerosol former". An aerosol former is used to describe any suitable known compound or mixture of compounds that, in use, facilitates formation of an aerosol and that is substantially resistant to thermal degradation at the operating temperature of the aerosol-generating substrate. Suitable humectants or aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred humectants or aerosol formers are polyhydric alcohols or mixtures thereof, such as propylene glycol, triethylene glycol, 1,3-butanediol and, most preferred, glycerine. The tobacco substrate or aerosol-forming substrate may comprise a single humectant or aerosol former. Alternatively, the tobacco substrate or aerosol-forming substrate may comprise a combination of two or more humectants or aerosol formers.

In various embodiments, the tobacco substrate or aerosol-forming substrate has a high level of humectant or aerosol former. As used herein, a high level of humectant means humectant content that is greater than about 10% or preferably greater than about 15% or more preferably greater than about 20%, by weight on a dry weight basis. The tobacco substrate or aerosol-forming substrate can also have a humectant or aerosol former content of between about 10% and about 30%, from about 15% and about 30%, or from about 20% and about 30%, by weight on a dry weight basis.

In many embodiments the overall length of the smoking article is between about 30 mm and about 130 mm. In some embodiments the overall length of the smoking article is about 85 mm or about 45 mm. The external diameter of smoking article can be between about 5.0 mm and about 12 mm, or between about 5.0 mm and about 8 mm, or 7.2 mm±10%. The overall length of the filter of the smoking article can be between about 18 mm and about 36 mm. In some embodiments the overall length of the filter is about 27 mm. Aerosol-generating substrates in heated smoking articles are typically significantly shorter in length than rods of combustible smokable material in conventional lit end smoking articles. The column of aerosol-generating substrates that is wrapped in heated smoking articles may have a length of between about 5 mm and about 20 mm.

Previous experiments have demonstrated that the covalent bonding of fatty acid groups to paper according to the invention does not significantly alter the grammage or permeability of the cellulosic material, e.g., paper. It is therefore not expected that the RTD of a filter made with the hydrophobic sheet material will deviate significantly from the untreated material.

A previous experiment has produced a filter with a circumference of 16.3 mm (16.24 to 16.36 mm) using crêpe paper having a grammage of 36 g/m$^2$ (34.7 to 37.3 g/m$^2$) and a width of 100 mm, crimped to result in a structure having a 1 mm pitch. The filter made from such a filter element exhibited an RTD of 6.6 mmWG per mm of the filter element. In another experiment, a filter was created with a diameter of 7.4-7.49 mm (circumference of 23.24-23.53 mm) and made with crêpe paper (Semi-White L126, 2646/

312, Swiss Quality Paper) having a grammage of 36 g/m$^2$ (34.7 to 37.3 g/m$^2$) and a width of 220 mm. FIG. 4 shows the relationship between width of paper before crimping (180 mm to 220 mm), the two levels of crimping, and the RTD. It was shown that the RTD can be varied according to the degree of crimping form 0.9 mmWG with a lower degree of crimping to 3.63 mmWG per mm of filter with a the higher degree of crimping.

Accordingly, the resistance to draw (RTD) of the smoking articles and the filters of the present disclosure can vary. In many embodiments the RTD of the smoking article is between about 50 to 150 mm $H_2O$. The RTD of a smoking article refers to the static pressure difference between the two ends of the specimen when it is traversed by an air flow under steady conditions in which the volumetric flow is 17.5 millilitres per second at the output end. The RTD of a specimen can be measured using the method set out in ISO Standard 6565:2002 with any ventilation (if present) blocked.

In one or more embodiments, smoking articles according to the present disclosure may be packaged in containers, for example in soft packs or hinge-lid packs, with an inner liner coated with one or more flavourants.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Figure 1:
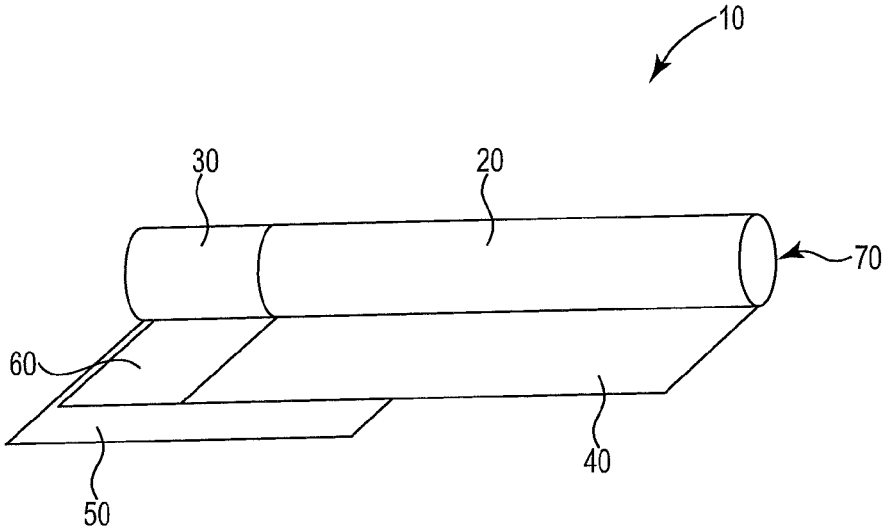
FIG. 1 is a schematic perspective view of an embodiment of a partially unrolled smoking article.
Figure 2:
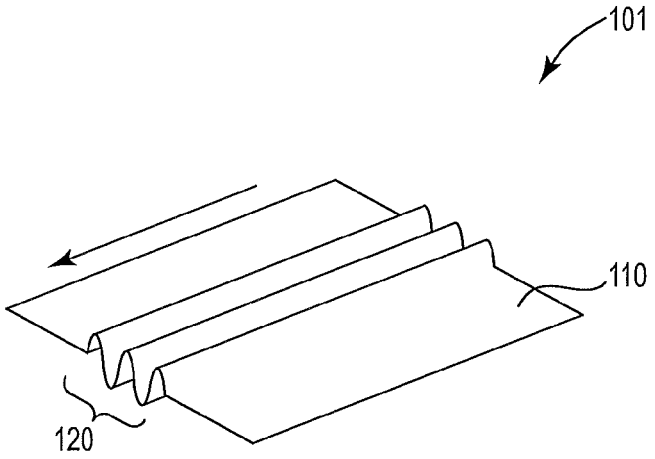
FIG. 2 is a schematic perspective view of an illustrative continuous sheet of hydrophobic material.
Figure 3:
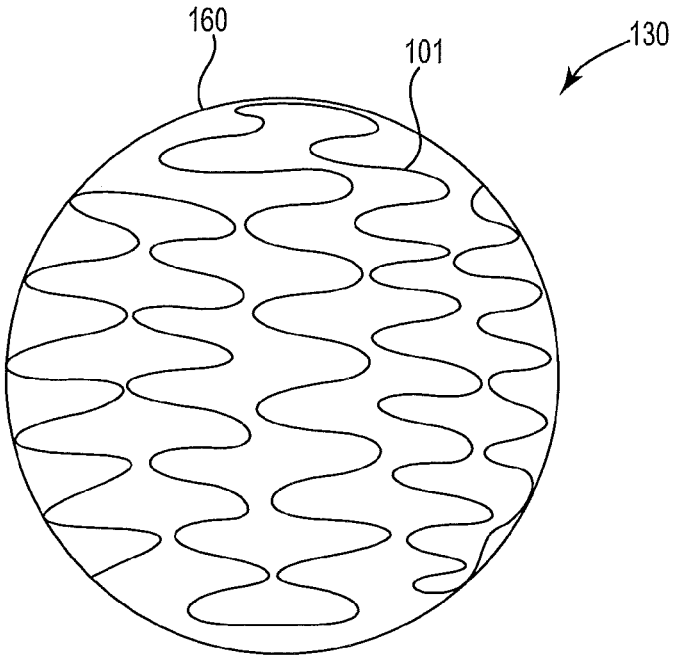
FIG. 3 is a schematic cross-sectional view of an illustrative filter element.
Figure 4:
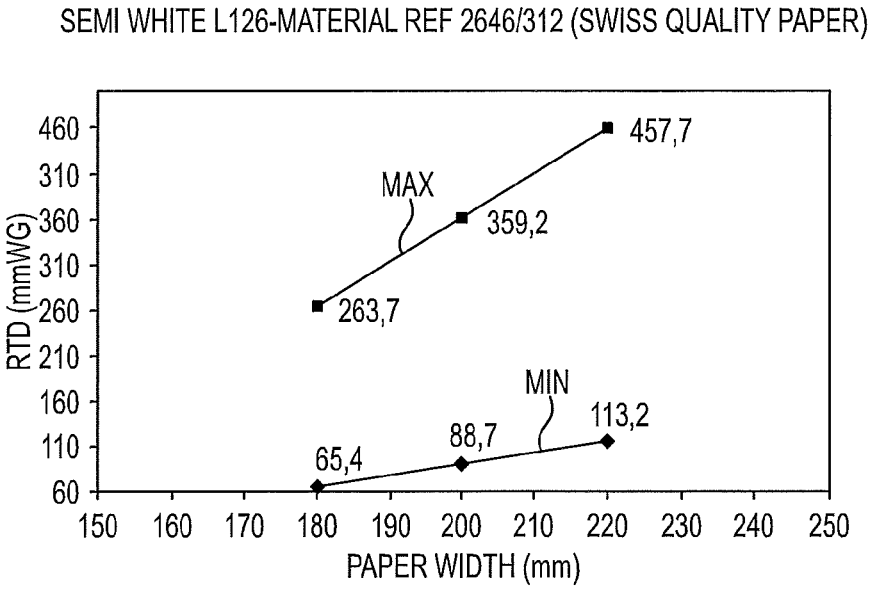
FIG. 4 is a graph of the relationship between width of paper before crimping (180 mm to 220 mm), the two levels of crimping, and the RTD.

The smoking articles depicted in FIGS. 1-3 illustrate one or more embodiments of smoking articles or components of smoking articles described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

Referring now to FIG. 1, a smoking article 10 is depicted. The smoking article 10 includes a tobacco substrate 20, such as a tobacco rod, and a mouth end segment 30 and a lit end tip 70. The mouthpiece includes a filter element 30 and can abut the tobacco substrate 20 in the finished smoking article 10. The depicted smoking article 10, includes a plug wrap 60 that circumscribes at least a portion of the filter or mouthpiece segment 30 and a wrapper 40 that circumscribes at least a portion of the tobacco substrate 20. A tipping paper 50 circumscribes the plug wrap 60 and a portion of the wrapper 40.

FIG. 2 illustrates a continuous sheet of hydrophobic cellulosic material 101 defining an crimped structure portion 120 with ridges and valleys that are parallel to the direction of transport (see the direction of the arrow) of the material in a crimping unit. An illustrative planar portion 110 is also shown.

FIG. 3 illustrates a cross-sectional view of one embodiment of the hydrophobic filter element 130. The crimped sheet of hydrophobic cellulosic material 101 is illustrated as being folded upon itself and packed into a cylindrical space with a substantially circular cross-section. Plug wrap 160 surrounds and secures the sheet of hydrophobic cellulosic material 101 in a cylindrical form.

The exemplary embodiments described above are not limiting. Other embodiments consistent with the exemplary embodiments described above will be apparent to those skilled in the art.

The invention claimed is:

1. A smoking article comprising:

a smokable material; and a filter downstream of the smokable material and comprising filtration material, the filtration material comprising a sheet of paper comprising hydrophobic groups covalently bonded to cellulosic material of the paper, wherein the hydrophobic group is formed by reacting a fatty acid group with a protogenic group of the cellulosic material, and wherein the sheet of paper is crimped along a longitudinal direction of the sheet and gathered transversely to form a cylindrical filter element.

2. The smoking article according to claim 1, wherein the crimped sheet of paper comprises parallel and co-extensive ridges and valleys along a longitudinal length of the crimped sheet, wherein the pitch measured in a transverse direction that is perpendicular to the direction of travel is about 1 mm.

3. The smoking article according to claim 1, wherein the width of the sheet of paper is about 150 mm to about 250 mm.

4. The smoking article according to claim 1, wherein diameter of the filter is about 4.5 mm to about 9.5 mm.

5. The smoking article according to claim 1, wherein the sheet of paper has a water contact angle of at least about 90 degrees.

6. The smoking article according to claim 1, wherein the sheet of paper exhibits a Cobb water absorption measurement value (at 60 seconds) of about 40 g/m$^2$.

7. The smoking article according to claim 1, wherein the sheet of paper has a basis weight in a range from about 20 to about 60 g/m$^2$, and the hydrophobic groups have a basis weight in a range from about 0.1 to about 5 g/m$^2$.

8. The smoking article according to claim 1, wherein the hydrophobic group comprises a fatty acid or fatty acid ester.

9. The smoking article according to claim 1, wherein the sheet of paper comprises fatty acid esters of cellulose.

10. The smoking article according to claim 1, wherein the hydrophobic group is covalently bonded to the cellulosic material by diffusion of a fatty acid halide on its surface without using a solvent.

11. The smoking article according to claim 10, wherein the fatty acid halide comprises palmitoyl chloride, stearoyl chloride, behenoyl chloride, or a mixture of palmitoyl chloride and stearoyl chloride.

12. A filter for a smoking article comprising:

a continuous sheet of paper distributed through a cross-section of a cylindrical filter element, the continuous sheet of paper comprising hydrophobic groups covalently bonded to cellulosic material of the continuous sheet of paper, wherein the hydrophobic group is formed by reacting a fatty acid group with a protogenic group of the cellulosic material, and wherein the continuous sheet of paper is crimped along a longitudinal direction of the sheet and gathered transversely to form a cylindrical filter element, the continuous sheet of paper having a water contact angle of at least about 90 degrees and a Cobb measurement value (at 60 seconds) of about 40 $g/m^2$ or less.

13. The filter according to claim 12, wherein the continuous sheet of paper has hydrophobic groups covalently bonded to protogenic groups on the paper.

14. The filter according to claim 12, wherein the continuous sheet of paper is crimped is arranged in layers that are packed to form a cylindrical filter element.

15. The smoking article according to claim 2, wherein the crimped sheet of paper comprises parallel and co-extensive ridges and valleys along a longitudinal length of the crimped sheet, wherein the pitch measured in a transverse direction that is perpendicular to the direction of travel is about 1 mm.

16. The smoking article according to claim 1, wherein the sheet of paper has a water contact angle of at least about 100 degrees, and the sheet of hydrophobic cellulosic material exhibits a Cobb water absorption measurement value (at 60 seconds) of 35 $g/m^2$ or less.

17. The smoking article according to claim 1 wherein the sheet of paper has a basis weight in a range from about 30 to about 45 $g/m^2$, and the hydrophobic groups have a basis weight in a range from about 0.1 to about 3 $g/m^2$.

18. The filter according to claim 12, wherein the continuous sheet of paper has fatty acid or fatty acid ester groups covalently bonded to the paper.

* * * * *